United States Patent [19]

Gurioli

[11] Patent Number: 4,644,152

[45] Date of Patent: Feb. 17, 1987

[54] CHECKING DEVICE FOR CIGARETTE GROUPS

[75] Inventor: Pasquino Gurioli, Bologna, Italy

[73] Assignee: Sasib S.p.A., Bologna, Italy

[21] Appl. No.: 677,353

[22] Filed: Dec. 3, 1984

[30] Foreign Application Priority Data

Dec. 6, 1983 [IT] Italy ..... 12686 A/83

[51] Int. Cl.[4] ..... G01N 9/04

[52] U.S. Cl. ..... 250/223 R; 209/535

[58] Field of Search ..... 209/535, 536, 576, 577; 250/222.1, 223 R; 356/237

[56] References Cited

U.S. PATENT DOCUMENTS

| | | | |
|---|---|---|---|
| 3,527,347 | 9/1970 | Marradi | 209/535 |
| 3,557,375 | 1/1971 | Schmermund | 250/223 R |
| 3,729,636 | 4/1973 | Merker | 250/223 R |
| 3,818,223 | 6/1974 | Gibson | 250/223 R |
| 3,829,695 | 8/1974 | Powell | 250/358 |
| 4,445,520 | 5/1984 | Knight | 131/282 |

*Primary Examiner*—Eugene R. LaRoche

*Assistant Examiner*—Steven J. Mottola

*Attorney, Agent, or Firm*—Spencer & Frank

[57] ABSTRACT

An optoelectronic device for checking the number of cigarettes making up an orderly group of cigarettes to be packed, and/or the regularity of the cigarette ends, includes a box-like cigarette-checking head (1) in which a number of feeler pins (2) are axially slidably mounted, the said feeler pins (2) being pressed against the cigarette ends, and controlling a number of intercepting screens (4) located between light sources (10), such as light emitting diodes, and photosensitive elements (11), such as phototransistors. Air under pressure is fed into the box-like cigarette-checking head (1), and is caused to first sweep the light sources (10) and the photosensitive elements (11). Thus, dust is prevented from settling down on the light sources (10) and on the photosensitive elements (11), and the air under pressure flowing out of the box-like cigarette-checking head (1) through the feeler pin-guiding bores (3, 8), will remove any dust from said bores and guarantee the slidability of the feeler pins (2).

15 Claims, 3 Drawing Figures

CHECKING DEVICE FOR CIGARETTE GROUPS

BACKGROUND AND SUMMARY OF THE INVENTION

This invention relates to optoelectronic devices for checking the number of cigarettes (or of any other rod-like articles) forming an orderly group of cigarettes to be packed, and/or the regularity of the cigarette ends, the said devices comprising a box-like cigarette-checking head provided with a plurality of parallel feeler pins which are axially slidably mounted in said head, in an arrangement matching with that of the cigarettes constituting a cigarette group, and the said cigarette-checking head being slightly pressed in a direction parallel to the feeler pins, with its feeler pins abutting against the cigarette ends, so as to resiliently shift back the feeler pins having met a cigarette with a regular end, and to thus remove the corresponding screens that normally prevent the light rays being emitted from suitable sources, such as, for example, light emitting diodes, from falling on photosensitive elements, such as, for example, phototransistors, whereby to achieve an electric condition which is indicative of the regularity of the checked cigarette group; whereas, from a feeler pin being not shifted back, there is derived the absence of the respective cigarette, and/or any irregularity in the cigarette end, and so an electric condition informing of a defect will be generated, that may be used for any desired purpose, such as for discarding later a pack with an incomplete or irregular cigarette group.

In the cigarette-checking devices of the said known type, the tobaco dust is apt to settle down within the box-like head bores in which the feeler pins are guided, thus tending to reduce the slidability of said pins. In an electro-mechanic cigarette-checking device of said known type, in which to each feeler pin is associated an electric contact that, for example, is closed when in rest condition, and is opened any time a feeler pin meets a cigarette, so that this pin will be resiliently shifted thereby, inwardly of the cigarette-checking head, or vice-versa, in order to guarantee the slidability of the feeler pins and to prevent any tobacco dust from penetrating into the hollow space in the cigarette-checking head and marring the electric contacts, air under pressure is fed into the said hollow space and is caused to flow out through the annular gaps between the feeler pins and the walls of the feeler pin-guiding bores in the cigarette-checking head, so that the said air under pressure will remove the tobacco dust tending to accumulate in said gaps. However, this arrangement is hardly applicable to the optoelectronic cigarette-checking devices of the type as disclosed in the preamble, or anyhow, it proves to be unsufficient for guaranteeing a satisfactory operation of these devices, since the inner dust resulting from the wear of the feeler pin-sliding surfaces, tends to settle down on the photosensitive elements and on the light sources, thus very shortly reducing or quite destroying their efficiency.

The object of the invention is to eliminate the aforementioned drawbacks, and to guarantee, in the optoelectronic cigarette-checking devices of the type as disclosed in the preamble, both the slidability of the feeler pins and a clean condition of the photosensitive elements and the light sources, simply by means of air under pressure.

This problem is solved by the invention thanks to the provision of means for feeding air under pressure into the hollow space in the box-like cigarette-checking head, so as to cause it to first sweep the photosensitive elements and/or the light sources. In this way, the air under pressure fed into the hollow space in the box-like cigarette-checking head will at first remove from the surfaces of the photosensitive elements and the light sources which are swept thereby, the dust deposit formed by any dust possibly existing in the interior of said head, whereby the said surface will be kept dust-free, and therefore always in a thoroughly efficient condition, and the said air under pressure will then flow out of the box-like cigarette-checking head, through the annular gaps between the feeler pins and the guides provided for the sliding thereof in the cigarette-checking head, thus removing from said gaps any tobacco dust, and guaranteeing the slidability of the feeler pins.

BRIEF DESCRIPTION OF THE DRAWINGS

These and other characteristic features of the invention will clearly appear in the following specification of one embodiment thereof, which is shown by way of a non-limiting example in the accompanying drawings, in which.

DESCRIPTION OF THE PREFERRED EMBODIMENT

Referring to the figures, an optoelectronic device for checking the number of the cigarettes composing an orderly group of cigarettes to be packed, comprises a box-like cigarette-checking head 1 which in known manner can be driven, in the axial direction of the cigarettes, near to, and away from the group of cigarettes to be checked. Axially slidably mounted in the cigarette-checking head 1 is a plurality of feeler pins 2 arranged parallel to one another and to the direction of movement of the cigarette-checking head 1. The number and the arrangement of the feeler pins 2 corresponds to the number and the arrangement of the cigarettes making up an orderly group of cigarettes to be checked. In the shown embodiment there are provided three parallel rows of feeler pins 2 arranged in an offset relation.

Figure 2:
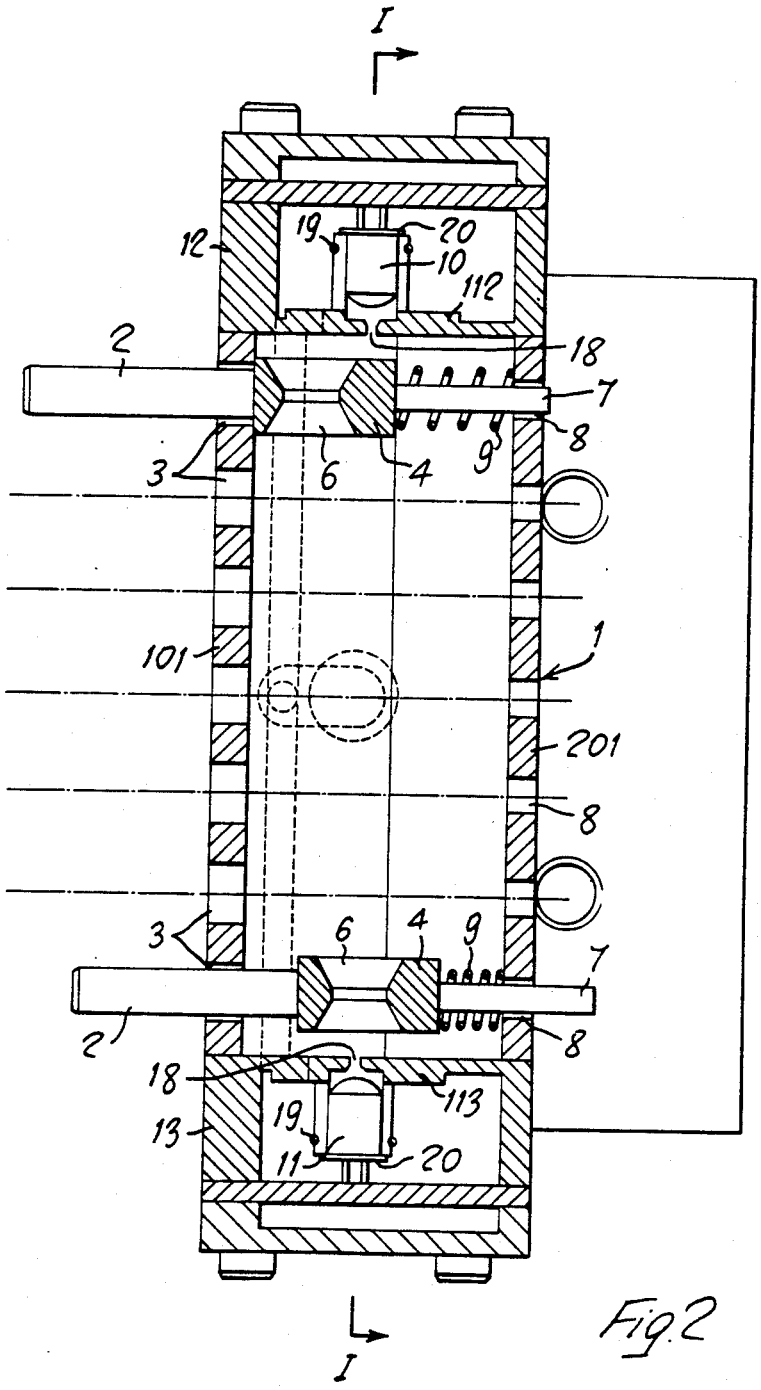
FIG. 2 is a section through the cigarette-checking head, taken on line II—II of FIG. 1.
Figure 3:
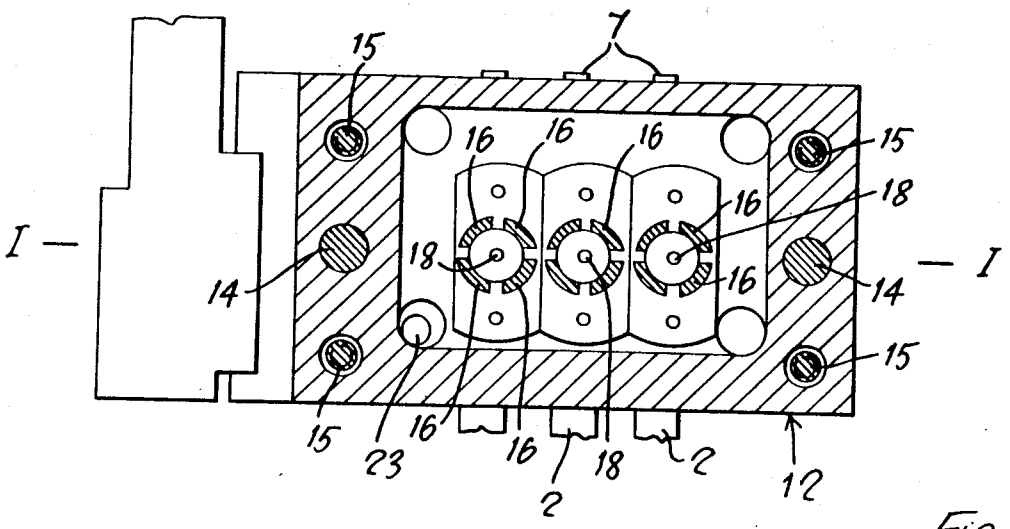
FIG. 3 shows the same cigarette-checking head in a section taken on line III—III of FIG. 1, with the light diodes taken off their seats, which are thus seen in their vacant condition.

More particularly, in the shown embodiment each feeler pin 2 is cylindrically shaped and is slidably guided in a corresponding bore 3 provided in the front wall 101 of the cigarette-checking head 1, namely in the wall thereof that is turned toward the group of cigarettes to be checked. At the interior of the box-like head 1, each feeler pin 2 is made integral with a prismatically shaped small block 4 which is slidably guided laterally between the inner walls 5 of said head 1, and is provided with an aperture 6 extending in the longitudinal direction of the respective feeler pin row. On the side lying opposite to the feeler pin 2, the apertured block 4 has a cylindrical appendix 7 which is slidably guided in a bore 8 provided in the rear wall 201 of the cigarette-checking head 1. A spring 9 wound round the rearward extending appendix 7 is provided between the said rear wall 201 and the apertured block 4, and is apt to urge and keep the respective feeler pin 2 in the forward direction, toward the group of cigarettes to be checked, whereby it sets the feeler pin in its rest position, in which the apertured block 4 is stopped against the front wall 101 of the box-like cigarette-checking head 1, and the feeler pin 2 is caused to fully project out of said head 1, as shown in the upper part of FIG. 2.

For each row of feeler pins 2 a light emitting diode 10 is provided at one end of the row, in correspondence of the respective side end of the box-like cigarette-checking head 1, while at the opposite, other end of the row a photosensitive element consisting, for example, of a receiver phototransistor 11, is provided in correspondence of the respective side end of the box-like cigarette-checking head 1. The light emitting diode 10 and the phototransistor 11 associated to each row of feeler pins 2 are set in an aligned relation, and their arrangement is such that when the feeler pins 2 of one row are in their rest position, i.e., they fully project out of the cigarette-checking head 1, the rays emitted from the respecive light emitting diode 10 will be intercepted by the blocks 4 acting as screen, as it appears evident in the upper part of FIG. 2.

To check the number of cigarettes making up an orderly cigarette group, the cigarette-checking head 1 will be pressed with its feeler pins 2 against the cigarette ends. When the cigarettes being checked are in the number as predetermined, and when they have regular ends, all the feeler pins 2 will be held back by the respective cigarettes, and will be all caused to retract relatively to the cigarette-checking head 1, against the action of the respective springs 9, to such an extent that the apertures 6 in blocks 4 will be set into alignment with the light emitting diodes 10 and the oppositely lying phototransistors 11, as shown in the lower part of FIG. 2. Therefore, the light rays emitted from the light emitting diodes 10 are then allowed to pass through the aligned apertures 6 in blocks 4 and to impinge on the oppositely lying respective phototransistors 11, whereby an electric condition is achieved, that is indicative of the regularity of the checked cigarette group.

When instead a cigarette in the checked group is missing, or a cigarette end is defective, for example empty, the matching feeler pin 2 will not be held back and caused to retract relatively to the cigarette-checking head 1, but will stay in its rest position, in which its apertured block 4 intercepts the light emitted from the respective light emitting diode 10, so that it will not allow this light to impinge on the matching, facingly arranged phototransistor 11. Thus, an electric condition will be generated, that is indicative of an irregularity in the checked cigarette group. This electric condition signalling a defect may be used, for example, for discarding a pack prepared with an incomplete or irregular cigarette group.

The light emitting diodes 10 and the phototransistors 11 are housed in their respective box-like block 12 or 13, which by means of pins 14 and screws 15 is fastened to the corresponding open side end of the box-like cigarette-checking head 1, so as to close the said end. Each light emitting diode 10 and each phototransistor 11 is seated into, and is locked within its respective housing, which consists of a plurality of fingers 16 arranged in a circular and angularly equispaced relation, so as to form tubular gripping means. All these gripping means 16 are made integral with the wall 112, 113 of the relative box-like block 12 or 13, which adheres against the respective open side end of the box-like cigarette-checking head 1. In these walls 112, 113, a bore 18 connecting the hollow space in the box-like cigarette-checking head 1 with the respective box-like lateral block 12, 13, is provided at the center of each tubular gripping means 16. The light emitting diodes 10 and the phototransistors 11 are fitted each into one respective gripping means 16 and are locked therewithin by means of a retaining ring 19 surrounding and firmly holding the fingers forming the said gripping means 16. Both the light emitting diodes 10 and the phototransistors 11 are provided with small flanges 20 for fixing the light emitting diodes 10 and the phototransistors 11 in their fully seated position, in which they terminate at a distance from their respective bore 18 in wall 112, 113, without closing or obstructing any bore 18. The light emitted by the light emitting diodes 10 and falling on the respective oppositely lying phototransistors 11, flows through the said bores 18.

Figure 1:
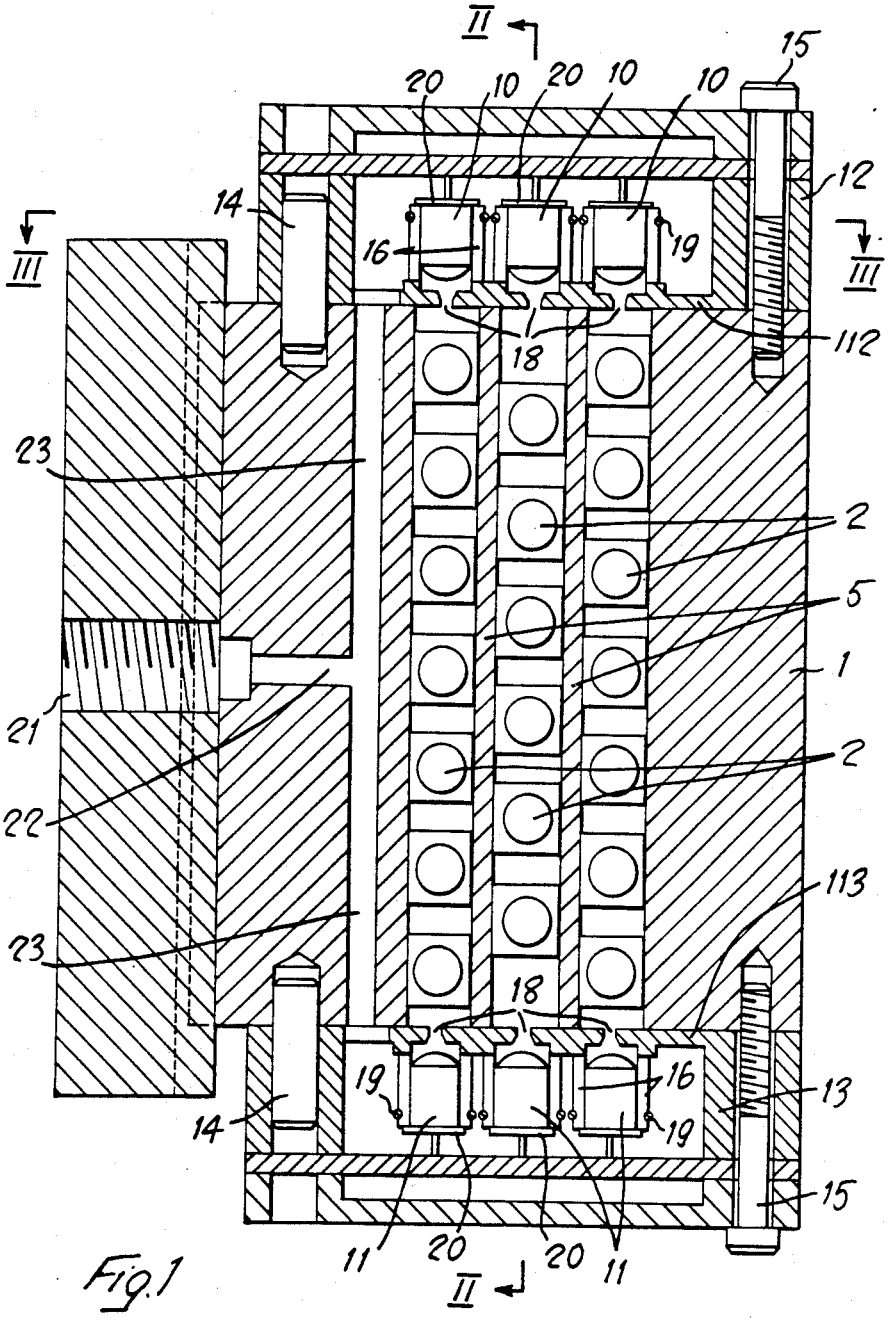
FIG. 1 shows a box-like head carrying the slidable feeler pins of an optoelectronic cigarette-checking device, in a section taken on line I—I of FIGS. 2 and 3.

To keep the light emitting diodes 10 and the phototransistors 11 dust-free, and to guarantee the slidability of the feeler pins 2, use is made of air under pressure that from the fitting pins 21 and through the ducts 22, 23 provided in the body of the box-like cigarette-checking head 1, is fed into the hollow space in the box-like lateral blocks 12 and 13, as it particularly appears in FIG. 1. From these blocks 12, 13, the air under pressure flows into the hollow space in the box-like cigarette-checking head 1, through the equispaced fingers forming the gripping means 16 firmly holding the light emitting diodes 10 and the phototransistors 11, and through the respective median bores 18. In this way, the air under pressure is caused to sweep the front surfaces of the light emitting diodes 10 and the phototransistors 11, whereby these surfaces are kept clear of any dust possibly present at the interior of the device. The air under pressure fed into the hollow space in the box-like cigarette-checking head 1 will flow out therefrom through the annular gaps formed around the feeler pins 2 and their rearward extending appendices 7, respectively fitted in the guide bores 3 and 8, thus removing any tobacco dust from said bores 3 and 8.

Of course the invention is not limited to the just described and shown embodiment, but it can be widely changed and modified. Thus, for example, the light emitting diodes 10 and/or the phototransistors 11 may be replaced with any other light sources and/or photosensitive elements. Also the lateral chambers of the box-like cigarette-checking head, in which the photosensitive elements and the respective light sources are housed, may be obtained in any desired manner, other than the box-like blocks 12, 13 applied on the side ends of the box-like cigarette-checking head 1. It is not even required that the photosensitive elements and the respective light sources be always housed in special chambers separate from the hollow space in the box-like cigarette-checking head 1 and communicating with this head 1 hollow space through one or more bores connected with each photosensitive element and each light source. It is in fact possible to locate the photosensitive elements and/or the light sources in the hollow space in the box-like cigarette-checking head, and to feed air under pressure into this hollow space by means of nozzles, or like means, adapted for producing air jets that are caused to sweep the said photosensitive elements and/or the said light sources, so as to prevent any deposit of dust thereon.

I claim:

1. An optoelectronic device for checking the number of rod-like articles making up an orderly group of articles to be packed, comprising:

a plurality of feeler pins having axes;

a box-like article checking head having a front wall and having first and second spaced-apart partition walls with respective first and second apertures therein, the head having a hollow space between the partition walls and the front wall having feeler pin guide bores which communicate with the hollow space, the feeler pins being mounted on the head and extending through the guide bores, the guide bores being disposed so that the feeler pins are mounted parallel to one another in an arrangement matching the arrangement of the articles in the group, the pins being axially slidable with respect to the head and the head being movable with respect to the group of articles;

means for resiliently biasing the pins toward the group of articles;

means for checking the articles of the group when the head is slightly pressed in a direction parallel to the feeler pin axes to cause the pins to abut against the ends of the articles, the means for checking including a light emitting element mounted on the head, the light emitting element being disposed outside the hollow space but communicating with the hollow space through the aperture in one of the partition walls, a light sensitive element mounted on the head to receive light from the emitting element, the light sensitive element being disposed outside the hollow space but communicating with the hollow space through the aperture in the other partition wall, and screen means mounted on the feeler pins for preventing light from reaching the light sensitive element unless all the feeler pins abut against respective article ends and are thereby resiliently shifted with respect to the head;

means mounted on the head for defining a chamber around one of the light emitting and light sensitive elements, the chamber communicating with the hollow space through the aperture in the respective partition wall; and means for feeding air under pressure into the chamber so that air sweeps the element in the chamber as the air flows through the respective aperture into the hollow space, the sweep of air preventing dust from settling on the element in the chamber, at least some of the air thereafter flowing out of the hollow space through the guide bores to prevent dust from being deposited in the guide bores.

2. A device according to claim 1, further comprising means mounted on the head for defining another chamber that is disposed around the other of the light emitting and light sensitive elements, the another chamber communicating with the hollow space through the aperature in the respective partition wall, and wherein the means for feeding air additionally comprises means for feeding air into the another chamber so that air sweeps the element in the another chamber as it flows through the respective aperture into the hollow space.

3. A device according to claim 2, wherein the element in the another chamber has a flange and is mounted on the head by another tubular gripping means, provided on the respective partition wall, for firmly holding the element in the another chamber at a position closely spaced from the respective aperture, the another gripping means comprising angularly equispaced and resiliently clamped further fingers having ends which contact the flange of the element in the another chamber.

4. A device according to claim 1, wherein the rod-like articles are cigarettes.

5. A device according to claim 1, wherein the articles making up the group are arranged in a plurality of rows and the feeler pins are arranged in corresponding rows, wherein each partition wall has at least one further aperture, wherein the means for checking further comprises at least one further light emitting element mounted on the head and communicating with the hollow space through a respective further aperture in one of the partition walls, and at least one further light sensitive element mounted on the head and communicating with the hollow space through a respective further aperture in the other partition wall, and wherein said screen means additionally comprises means for preventing light from reaching the at least one further light sensitive element.

6. A device according to claim 1, wherein the means defining a chamber comprises box-like blocks fastened as covers to the respective partition wall.

7. A device according to claim 1, wherein the element in the chamber has a flange and is mounted on the head by tubular gripping means, provided on the respective partition wall, for firmly holding the element at a position closely spaced from the respective aperture, the gripping means comprising angularly equispaced and resiliently clamped fingers having ends which contact the flange of the element.

8. An optoelectronic device for checking the regularity of the ends of rod-like articles that make up an orderly group of articles to be packed, comprising:

a plurality of feeler pins having axes;

a box-like article checking head having a front wall and having first and second spaced-apart partition walls with respective first and second apertures therein, the head having a hollow space between the partition walls and the front wall having feeler pin guide bores which communicate with the hollow space, the feeler pins being mounted on the head and extending through the guide bores, the guide bores being disposed so that the feeler pins are mounted parallel to one another in an arrangement matching the arrangement of the articles in the group, the pins being axially slidable with respect to the head and the head being movable with respect to the group of articles;

means for resiliently biasing the pins toward the group of articles;

means for checking the articles of the group when the head is slightly pressed in a direction parallel to the feeler pin axes to cause the pins to abut against the ends of the articles, the means for checking including a light emitting element mounted on the head, the light emitting element being disposed outside the hollow space but communicating with the hollow space through the aperture in one of the partition walls, a light sensitive element mounted on the head to receive light from the emitting element, the light sensitive element being disposed outside the hollow space but communicating with the hollow space through the aperture in the other partition wall, and screen means mounted on the feeler pins for preventing light from reaching the light sensitive element unless all the feeler pins abut against respective regular article ends and are thereby resiliently shifted with respect to the head;

means mounted on the head for defining a chamber around one of the light emitting and light sensitive elements, the chamber communicating with the hollow space through the aperture in the respective partition wall; and means for feeding air under pressure into the chamber so that air sweeps the element in the chamber as the air flows through the respective aperture into the hollow space, the sweep of air preventing dust from settling on the element in the chamber, at least some of the air thereafter flowing out of the hollow space through the guide bores to prevent dust from being deposited in the guide bores.

9. A device according to claim 8, wherein the means defining a chamber comprises box-like blocks fastened as covers to the respective partition wall.

10. A device according to claim 8, wherein the element in the chamber has a flange and is mounted on the head by tubular gripping means, provided on the respective partition wall, for firmly holding the element at a position closely spaced from the respective aperture, the gripping means comprising angularly equispaced and resiliently clamped fingers having ends which contact the flange of the element.

11. A device according to claim 8, further comprising means mounted on the head for defining another chamber that is disposed around the other of the light emitting and light sensitive elements, the another chamber communicating with the hollow space through the aperture in the respective partition wall, and wherein the means for feeding air additionally comprises means for feeding air into the another chamber so that air sweeps the element in the another chamber as it flows through the respective aperture into the hollow space.

12. A device according to claim 11, wherein the element in the another chamber has a flange and is mounted on the head by another tubular gripping means, provided on the respective partition wall, for firmly holding the element in the another chamber at a position closely spaced from the respective aperture, the another gripping means comprising angularly equispaced and resiliently clamped further fingers having ends which contact the flange of the element in the another chamber.

13. A device according to claim 8, wherein the rod-like articles are cigarettes.

14. A device according to claim 8, wherein the articles making up the group are arranged in a plurality of rows and the feeler pins are arranged in corresonding rows, wherein each partition wall has at least one further aperture, wherein the means for checking further comprises at least one further light emitting element mounted on the head and communicating with the hollow space through a respective further aperture in one of the partition walls, and at least one further light sensitive element mounted on the head and communicating with the hollow space through a respective further aperture in the other partition wall, and wherein said screen means additionally comprises means for preventing light from reaching the at least one further light sensitive element.

15. A device according to claim 8, wherein the device additionally serves to check the number of rod-like articles that make up the orderly group.

* * * * *